313-422 SR
11/3/81 OR 4,298,819

United States Patent [19]

Credelle et al.

[11] 4,298,819

[45] Nov. 3, 1981

[54] BEAM CLEAN UP STRUCTURE FOR FLAT PANEL DISPLAY DEVICES

[75] Inventors: Thomas L. Credelle, Plainsboro; Robert A. Gange, Belle Mead, both of N.J.

[73] Assignee: RCA Corporation, New York, N.Y.

[21] Appl. No.: 135,124

[22] Filed: Mar. 28, 1980

[51] Int. Cl.[3] ..... H01J 29/08

[52] U.S. Cl. ..... 313/422; 313/432

[58] Field of Search ..... 313/400, 422, 432, 439; 315/366

[56] References Cited

U.S. PATENT DOCUMENTS

| | | | |
|---|---|---|---|
| 4,069,439 | 1/1978 | Anderson | 313/422 |
| 4,103,204 | 7/1978 | Credelle | 313/422 |
| 4,128,784 | 12/1978 | Anderson | 313/422 |

OTHER PUBLICATIONS

Cook et al., *Slalom Focusing*, Proc. of the IRE, Nov. 1957, pp. 1517–1522 especially FIG. 7 on p. 1521.

*Primary Examiner*—Paul L. Gensler
*Attorney, Agent, or Firm*—Eugene M. Whitacre; Glenn H. Bruestle; Lester L. Hallacher

[57] ABSTRACT

In a flat panel display device including spaced parallel guide meshes between which electron beams propagate, the guide meshes are formed to include projections extending into the electron beam propagation space. The projections restrict the electron propagation space in a direction perpendicular to the planes of the guide meshes and thus capture electrons near the extremities of the space.

16 Claims, 6 Drawing Figures

BEAM CLEAN UP STRUCTURE FOR FLAT PANEL DISPLAY DEVICES

BACKGROUND OF THE INVENTION

This invention relates generally to flat panel display devices and particularly to an electron beam clean up structure for such devices.

U.S. Pat. No. 4,069,439 discloses a flat panel display device including a pair of spaced parallel beam guide meshes between which electrons are propagated as beams. Arranged between the guide meshes at the end where electrons enter the guide structure are two additional meshes which narrow the electron propagation space for an initial portion of the beam guide structure. These additional meshes are used to capture electrons which are propagating near the guide meshes and thereby serve as beam clean up meshes. Operationally, the use of such clean up meshes is satisfactory. However, the additional meshes add complexity and cost to the display device and create a problem in aligning the clean up members with the guide meshes.

U.S. Pat. No. 4,128,784 also shows a flat panel display device utilizing parallel spaced electron beam guide meshes between which electrons are propagated as beams. The ends of the beam guides nearest th cathode are bent to converge toward one another and thereby narrow the space between which electrons can be injected into the propagation space. The bent portions, therefore, serve as a beam clean up means. This device is not adequate for high performance beam clean up because only a small number of electrons are captured by the bent portions. The major portion of the electrons have a velocity vector directed such that they miss the bent portions and enter the narrow space between the guide meshes and propagate along the beam guide near the guide meshes.

SUMMARY OF THE INVENTION

In a flat panel display device the beam guides are formed to remove from the electron beam electrons that are travelling in a direction causing them to impinge upon the beam guide. The beam guide meshes are shaped to form projections protruding into the space in which the electrons propagate to capture the electrons travelling near the guide meshes.

DETAILED DESCRIPTION OF THE PREFERRED EMBODIMENTS

Figure 1:
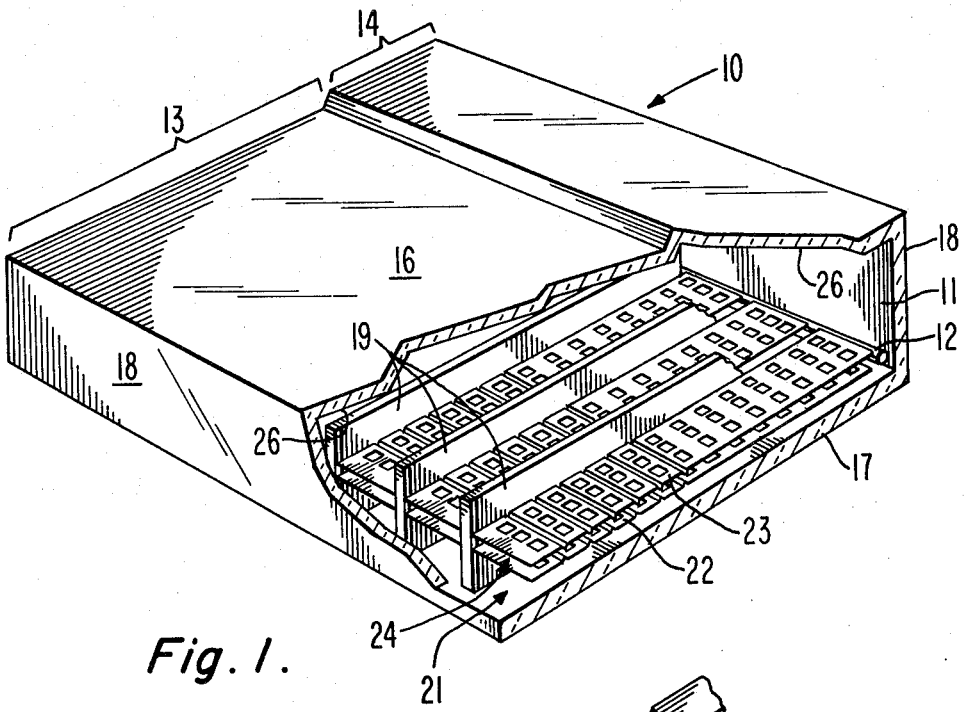
FIG. 1 is a simplified perspective view of a flat panel display device incorporating a preferred embodiment of the invention.

FIG. 1 shows one form of a flat panel display device 10 incorporating one of the preferred embodiments of the present invention. The display device 10 includes an evacuated envelope 11 having a display section 13 and an electron gun section 14. The envelope 11 includes a faceplate 16 and a baseplate 17 held in spaced parallel relationship by side walls 18.

A plurality of spaced parallel support vanes 19 are arranged between the faceplate 16 and the baseplate 17 to provide internal support against external atmospheric pressure and to divide the envelope 11 into a plurality of channels 21. Each of the channels 21 encloses a beam guide assembly for propagating electron beams along the channels 21. The beam guide assemblies include pairs of spaced parallel beam guide meshes 22 and 23 extending transversely across the channels and longitudinally along the channels from the gun section 14 to the opposite side wall 18.

A line cathode 12 is arranged to emit electrons into the space 24 between the beam guides. The inside surface of the faceplate 16 is provided with a phosphor screen 26 which luminesces when struck by electrons. The screen can be composed of three different phosphors arranged in a pattern, such as repeating triads of stripe-shaped elements, to produce a color visual output in response to electron excitation. A focus mesh (not shown) is spaced from and parallel to the mesh 23. A series of electrodes (not shown) is arranged on the inside surface of the baseplate 17 normal to the lengths of the channels 21. The focus mesh and electrodes are biased to focus the electrons in the space 24.

Figure 2:
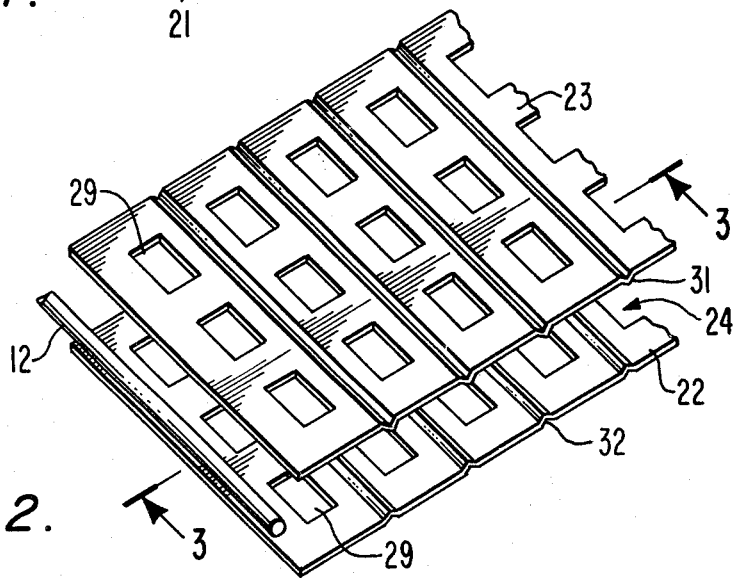
FIG. 2 is an enlarged perspective view, partially broken away, of a portion of the device of FIG. 1.

As shown in FIG. 2 the guide meshes 22 and 23 contain apertures 29 which are arranged in columns longitudinally along the meshes and in rows transversely across the meshes. Typically, in the art the transverse rows of apertures are referred to as periods. Electrons are emitted from the cathode 12 and propagate in the space 24 between the meshes 22 and 23. Each column of the apertures 29 serves as an electron beam guide so that each pair of meshes is capable of propagating three electron beams.

The guide mesh 23 contains a plurality of embossed projections 31 extending transversely across the mesh and preferably equally spaced between the rows of apertures 29. Similarly, the mesh 22 contains embossed projections 32 which also extend transversely across the mesh between the rows of apertures 29. The projections 31 and 32 are aligned across the space 24 and protrude into the space 24 to reduce the dimension of the space which is normal to the planes of the meshes.

Figure 3:
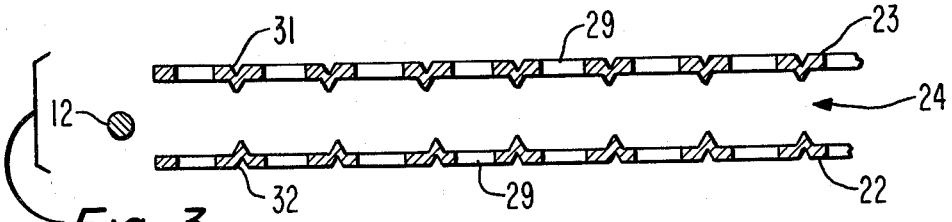
FIG. 3 is a cross section taken along line 3—3 of FIG. 2.

As shown in FIG. 3, because the projections 31 and 32 protrude into the space 24, electrons travelling along the extremities of the space strike the projections 31 and 32 thereby narrowing the electron beam. Electrons propagating along the space 24 follow a sinusoidal path the wavelength of which is dependent upon the physical and operating parameters of the device. Effective beam clean up requires that projections 31 and 32 be present for a sufficient number of periods to equal the wavelength of the electron beam. However, all the electrons within the electron beam are not in phase and accordingly additional projections are required to realize effective beam clean up. For example, an electron beam wavelength of six periods is obtained when the guide meshes 22 and 23 are spaced by 50 mils (0.125 cm), the extraction electrodes are spaced from the mesh 22 by 20 mils (0.05 cm), the meshes 22 and 23 are biased at +70 volts, the extraction electrodes are biased at +350 volts and the apertures 29 have a longitudinal dimension of 74 mils (0.19 cm) and are longitudinally spaced by 50 mils (0.125 cm). Accordingly, because of the difference in the phases of the electrons within the electron beam, projections would typically be used for nine periods. If desired, clean up projections can be used for two full wavelengths of the electron beam, twelve periods for the examplary parameters above. The space 24 is unrestricted along the guide meshes beyond the projections 31 and 32, which are furtherest from the cathode 12.

The apertures 29 in the guide meshes 22 and 23 are aligned across the space 24. The projections 31 and 32 are preferably centered between the rows of apertures and, therefore, also are aligned across the space 24. Accordingly, the projections do not adversely affect the electrostatic fields which focus the electrons in the space 24.

The projections 31 and 32 are formed integral with the guide meshes 23 and 22, respectively, and therefore, can be precisely located during the fabrication of the guide meshes. Additionally, the guide meshes 22 and 23 preferably are identical. For these reasons the guide meshes can be fabricated and assembled using mass production techniques.

The integral forming of the projections 31 and 32 in the guide meshes causes some stretching and thinning of the mesh metal along the lines where the shaped projections are formed. This can be avoided by etching, scribing, or otherwise removing a small amount of metal along the lines where bending occurs during the formation of the projections.

Figure 4:
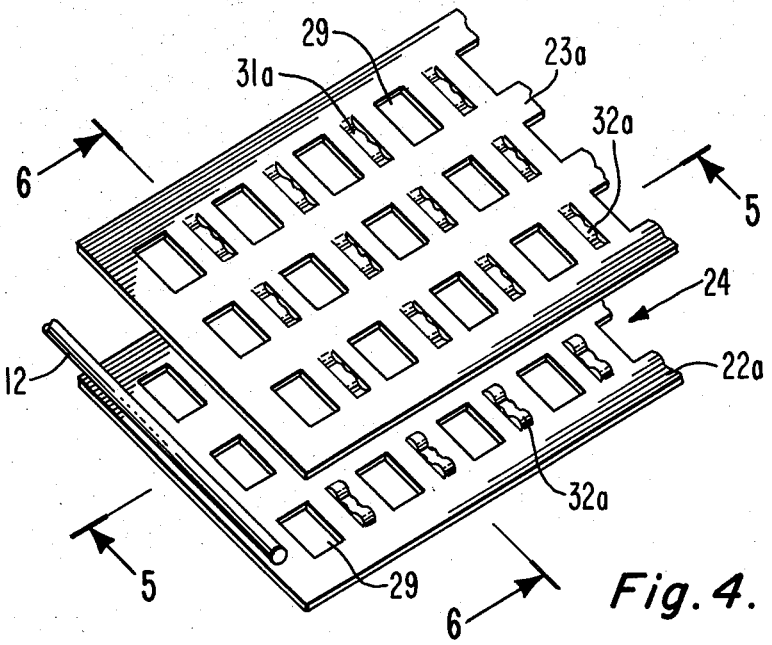
FIG. 4 is a perspective view, partially broken away, of another preferred embodiment.

FIG. 4 shows a beam guide structure including spaced parallel guide meshes 22*a* and 23*a*. The meshes 22*a* and 23*a* are identical to the meshes 22 and 23 of FIG. 2 with the exception of the configuration of the projections 31*a* and 32*a* which replace the projections 31 and 32 on FIG. 2.

In the FIG. 4 embodiment the electron beam clean up structure consists of partially struck ribbon-like projections 31*a* and 32*a* which protrude into the space 24 between the meshes 22*a* and 23*a*. The projections 31*a* and 32*a* are aligned with the columns of apertures 29 and are arranged in transverse rows preferably centered between the transverse rows of the apertures 29. The transverse dimension of the projections 31*a* and 32*a* is greater than the transverse dimension of the apertures 29. Additionally, as shown in FIG. 5, the projections 31*a* and 32*a* are preferably centered between the apertures 29 and are aligned across the space 24.

Figure 6:
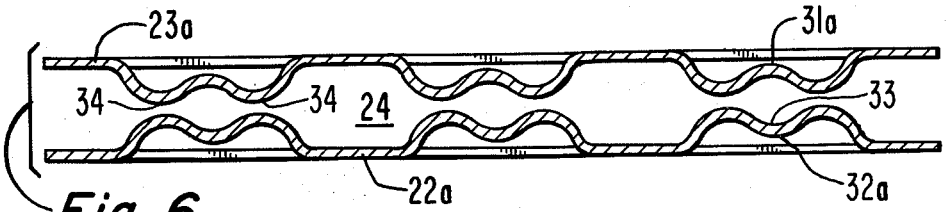
FIG. 6 is a cross section taken along line 6—6 of FIG. 4.

As shown in FIG. 6, the ribbon projections 32*a* and 32*b* are slightly concave in the center portions 33 so that the outer portions 34 protrude into the space 24 further than the center portions. The electron beams propagate along the projections in the vicinity of the centers 33 so that the outer portions 34 serve as transverse clean up for the electron beams. The center portions 33 of the projections 31*a* and 32*a* each protrude into the space 24 a distance which is approximately 20% of the total dimension of the space in the direction perpendicular to the planes of the meshes.

Figure 5:
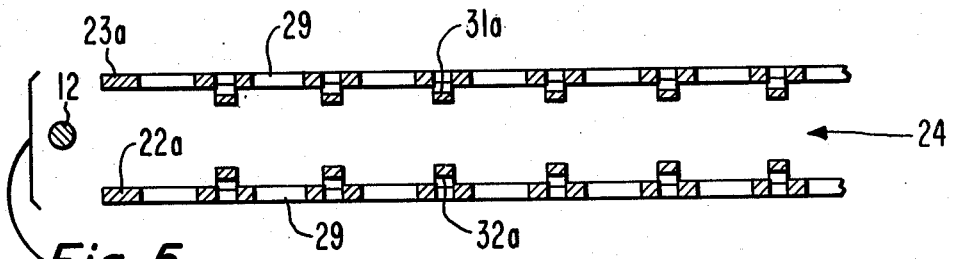
FIG. 5 is a cross section taken along line 5—5 of FIG. 4.

In the embodiments shown in FIGS. 4, 5 and 6 the meshes 22*a* and 23*a* are identical and, therefore, the construction of the meshes is simplified. Additionally, because the projections 31*a* and 32*a* are integral with the meshes, mass production techniques can be used to precisely manufacture the meshes.

What is claimed is:

1. In a display device including two parallel spaced guide meshes forming a space between said guide meshes, said meshes having a plurality of apertures arranged in columns longitudinally along said meshes and rows transversely across said meshes, said columns of apertures serving as guide paths for propagating electron beams between said meshes in said space, the improvement comprising:

electron beam clean up means for confining the cross section of said electron beams to maximum dimensions, said clean up means including a plurality of projections formed in said guide meshes between said rows of apertures and protruding into said space between said guide meshes.

2. The display device of claim 1 wherein said projections are embossed in said meshes and extend across the entire transverse dimension of said guide meshes.

3. The display device of claim 2 wherein said projections are substantially equally spaced between successive rows of said apertures.

4. The display device of claim 3 wherein there is a maximum of nine of said projections.

5. The display device of claim 4 wherein the first of said projections is positioned between the first and second rows of apertures.

6. The display device of claim 5 wherein said projections are V-shaped and restrict a maximum of 40% of the total dimension of said space in a direction perpendicular to the planes of said guide meshes.

7. The display device of claim 1 wherein said projections are ribbon-like elements struck from said meshes and are arranged in transverse rows between said rows of apertures and in longitudinal columns coincident with said columns of apertures.

8. The display device of claim 7 wherein said rows of ribbon projections are substantially equally spaced between said rows of apertures.

9. The display device of claim 8 wherein there is a maximum of nine of said rows of ribbon projections.

10. The display device of claim 9 wherein the first row of ribbon projections lies between the first and second row of apertures.

11. The display device of claim 7 wherein said ribbon projections are curved into the space between said guide meshes to provide both longitudinal and transverse electron beam clean up.

12. The display device of claim 11 wherein said ribbon projections protrude into said space between said guide meshes a first distance in the proximity of the edges of said apertures and a second distance in the proximity of the centers of said apertures.

13. The display device of claim 12 wherein said first distance is greater than said second distance.

14. The display device of claim 13 wherein the total second distance protrusion of said ribbon projections in both of said guide meshes is a maximum of 40% of the total spacing between said guide meshes.

15. The display device of claim 2 wherein said projections are arranged in a portion of said guide meshes having a predetermined length measured along the longitudinal dimension of said meshes, said predetermined length being at least as long as the propagation wavelength of said electron beams.

16. The display device of claim 7 wherein said ribbon projections are arranged in a portion of said guide meshes having a predetermined length measured along the longitudinal dimension of said meshes, said predetermined length being at least as long as the propagation wavelength of said electron beams.

* * * * *